US006827123B2

(12) United States Patent
Huang

(10) Patent No.: US 6,827,123 B2
(45) Date of Patent: Dec. 7, 2004

(54) OVEN SHELL AND METHOD OF FABRICATING SAME

(76) Inventor: Sandy Huang, No. 13, Lane 31, Minsheng 11 St., Gueiren Shiang, Tainan (TW)

( * ) Notice: Subject to any disclaimer, the term of this patent is extended or adjusted under 35 U.S.C. 154(b) by 113 days.

(21) Appl. No.: 10/359,183

(22) Filed: Feb. 6, 2003

(65) Prior Publication Data

US 2004/0154778 A1 Aug. 12, 2004

(51) Int. Cl.[7] ..... B22D 25/00
(52) U.S. Cl. ..... 164/113; 164/312
(58) Field of Search ..... 164/113, 312–318; 29/898.051, 527.5, 527.6, DIG. 13

(56) References Cited

U.S. PATENT DOCUMENTS 4,192,431 A * 3/1980 Brown ..... 220/62
4,245,615 A * 1/1981 Moss ..... 126/273 R
4,609,801 A * 9/1986 Spencer et al. ..... 219/756
4,805,592 A * 2/1989 Enami ..... 126/273 R
5,818,017 A * 10/1998 Ye et al. ..... 219/756

* cited by examiner

*Primary Examiner*—Kiley Stoner
*Assistant Examiner*—Kevin McHenry
(74) *Attorney, Agent, or Firm*—Birch, Stewart, Kolasch & Birch LLP

(57) ABSTRACT

An oven shell and a method of fabricating same includes forming molds which have a plurality of indented troughs spaced from one another for a selected interval on diagonal locations according to preset frame rims and panels. Frame rims and an upper panel, a lower panel, side panels and a rear panel of different dimensions are formed through the forming molds by die casting a metal material. The frame rims and the upper panel, the lower panel and side panels are coupled and assembled according to preset oven shell locations to form the oven shell. By coupling the elements in the diagonal fashion, oven shells of different dimensions and shapes may be made at a reduced cost and assembly is much convenient.

4 Claims, 16 Drawing Sheets

OVEN SHELL AND METHOD OF FABRICATING SAME

FIELD OF THE INVENTION

The present invention relates to an oven shell and a method of fabricating same.

BACKGROUND OF THE INVENTION

With continuous advances of high technologies, applications of ovens are no longer limited to households. They have been gradually expanded for use in areas such as shops and stores. One of the appeals of the oven is its abundant availability of specifications and versatility. Research and development of the oven have heavily focused on the design of dimensions and exterior shapes to achieve the goals of saving costs and convenient assembly. However, due to different sizes and capacities of the ovens, the oven shells often have to go through many different fabrication processes on the blank sheets such as stamping, punching, and flanging to form various types of panels for the shells.

The fabrication processes mentioned above not only are very tedious and complicated, they are also very time-consuming and result in a great waste of materials. The bending and flanging processes could involve dozens of operation steps. For instance, to fabricate the oven shell, referring to FIG. 1, first, ventilating holes must be formed by punching on the blank sheet; then the sheet is stamped and flanged according to required dimensions from the edges to form the shape desired (as shown in FIG. 2). Referring to FIG. 3, the operation panel of the oven has a lot of bending flanges and bulged and indented portions. All this slows down the speed of mass production. And transportation of the shells also is difficult. Storage and warehousing of the finished products take a lot of space. The residual cutting sheets from the viewing windows become scraps that are difficult to recycle. Consuming materials do not have environmental protection effect. The processes are too complicated and do not have high economic effectiveness. Moreover, different operators and workers often produce products of inconsistent profiles and qualities, or even result in product defects and cannot be recycled or reclaimed.

The invention aims at providing a method and product for fabricating oven shells that may be wedged and coupled according to required dimensions and shapes. The method of the invention employs forming molds which are symmetrical diagonally to form oven shells that can greatly reduce molding costs and improve assembly convenience.

SUMMARY OF THE INVENTION

Therefore the primary object of the invention is to resolve the aforesaid disadvantages. The invention provides an oven shell that may be coupled diagonally according to different dimensions and shapes to save molding costs. The forming mold has a plurality of indented trough zones spaced from one another at desired intervals on the diagonal locations according to preset frame rims and panels. A metal material is formed by die casting to produce the frame rims and panels of different dimensions and shapes. The frame rims and panels may be assembled according to preset locations on the shell, and coupled diagonally through the forming molds to form the oven shell.

Another object of the invention is to form preset frame rims and panels of different dimensions on the forming molds to allow neighboring frame rims and panels formed by die casting to couple diagonally for assembly and fastening.

Yet another object of the invention is to form the frame rims and panels from metal by die casting.

Still another object of the invention is to form the components of the oven shell from molten metal by die casting to facilitate recycling and conform to environmental protection requirements.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
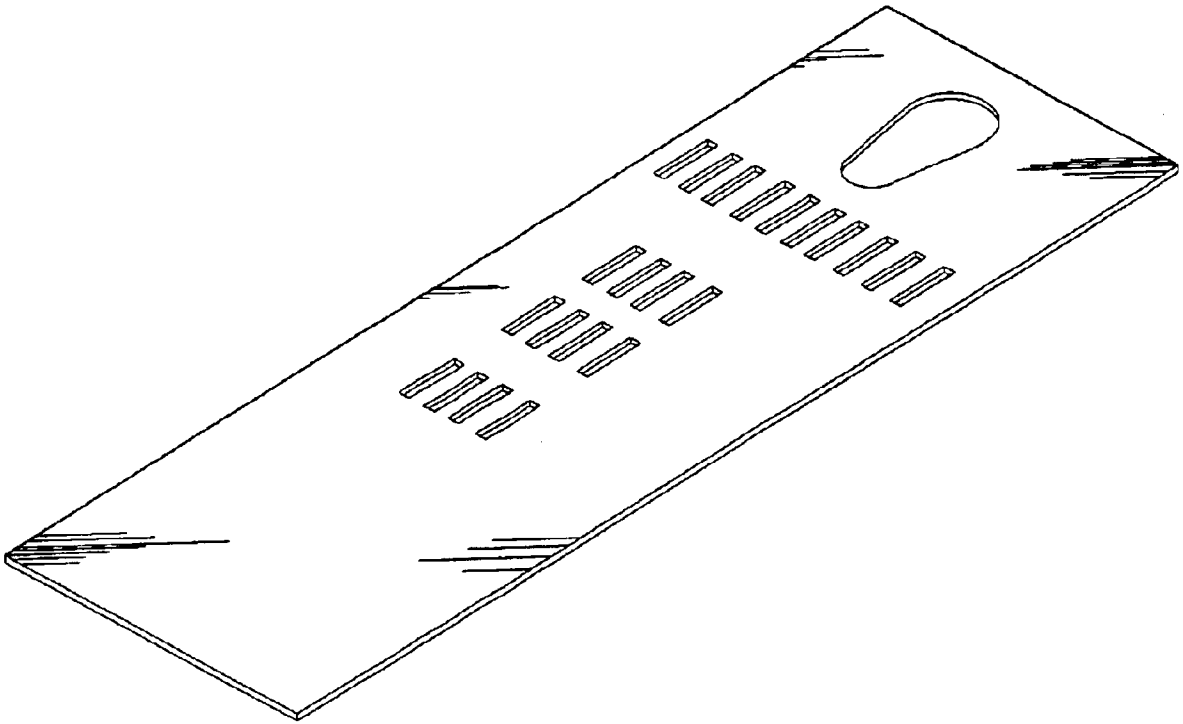
PRIOR ART Fig. 1
FIG. 1 is a perspective view of a conventional sheet before stamping.
Figure 2:
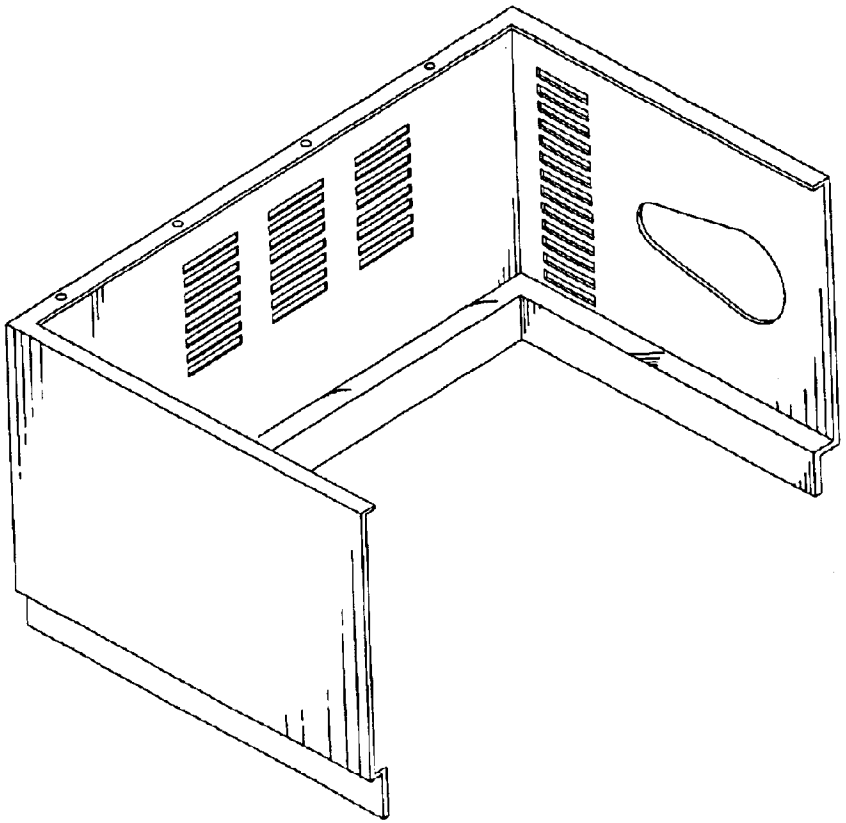
PRIOR ART Fig. 2
FIG. 2 is a perspective view of the sheet of FIG. 1 after punching to form holes.
Figure 3:
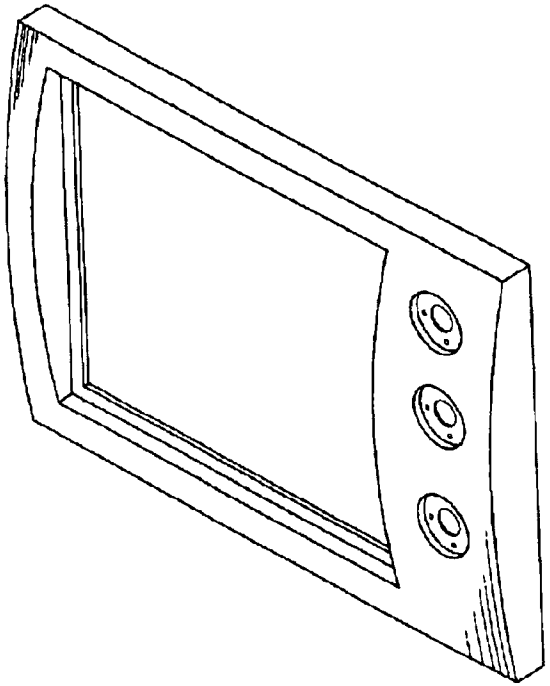
PRIOR ART Fig. 3
FIG. 3 is a perspective view of a conventional sheet being stamped and punched to form a front panel of the oven.
Figure 4:
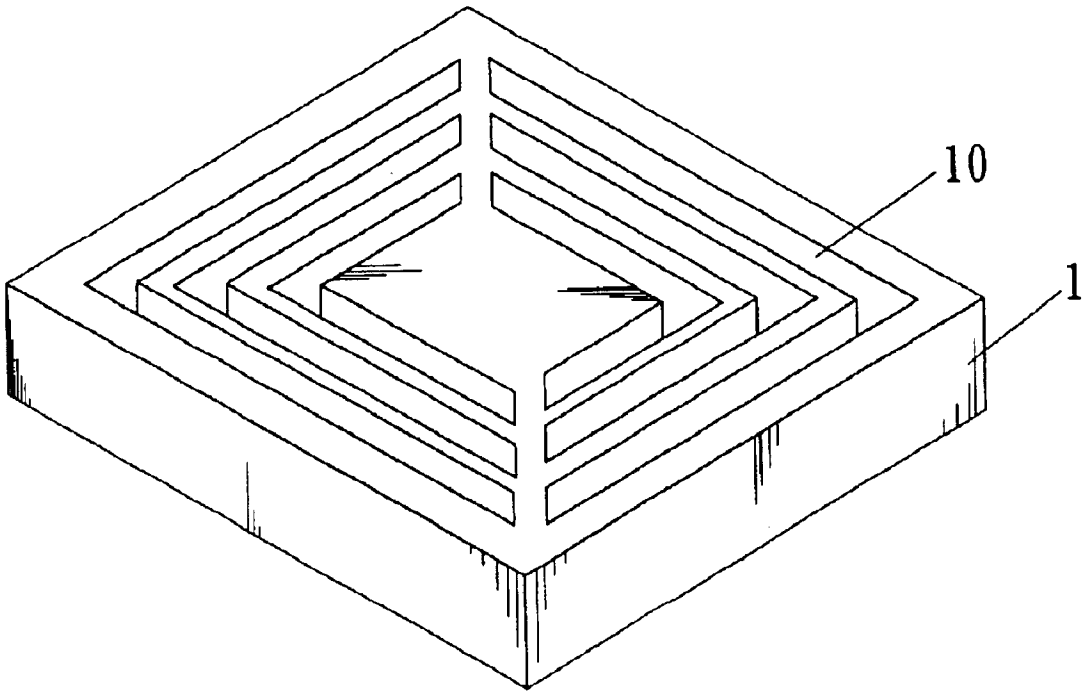
FIG. 4 is a perspective view of a forming mold for frame rims of the invention.
Figure 5:
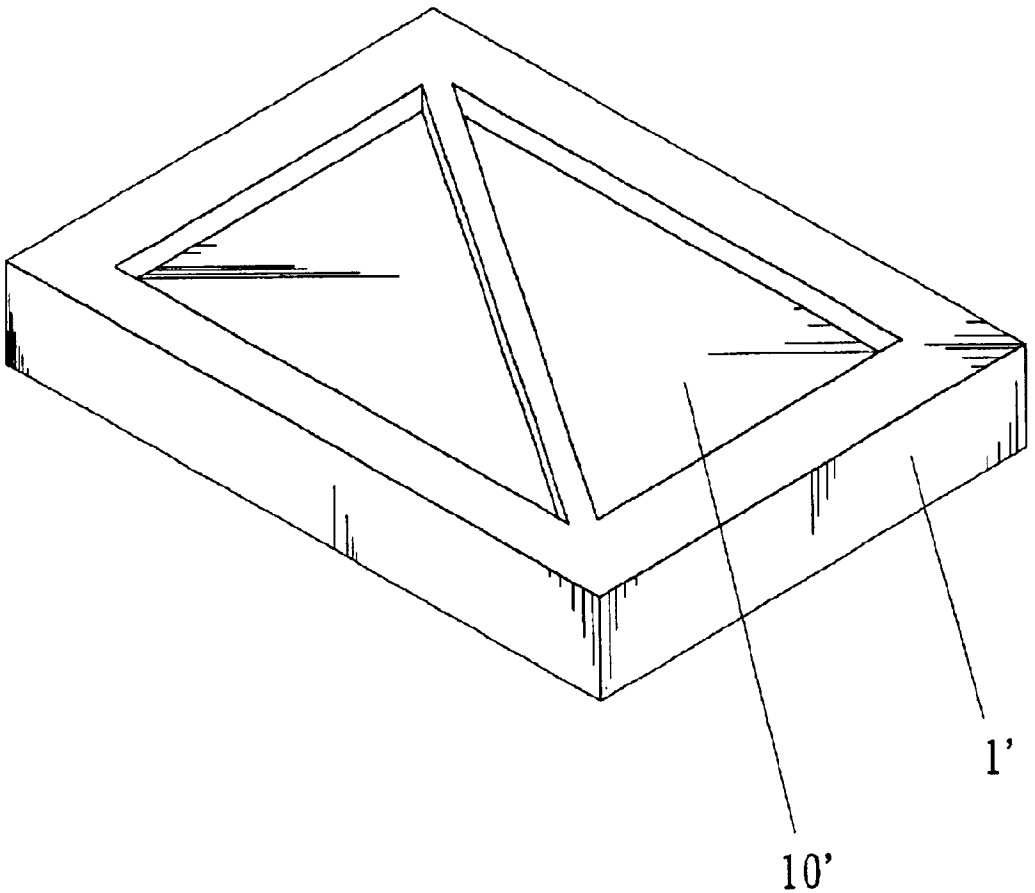
FIG. 5 is a perspective view of a forming mold for the front panel of the invention.
Figure 6:
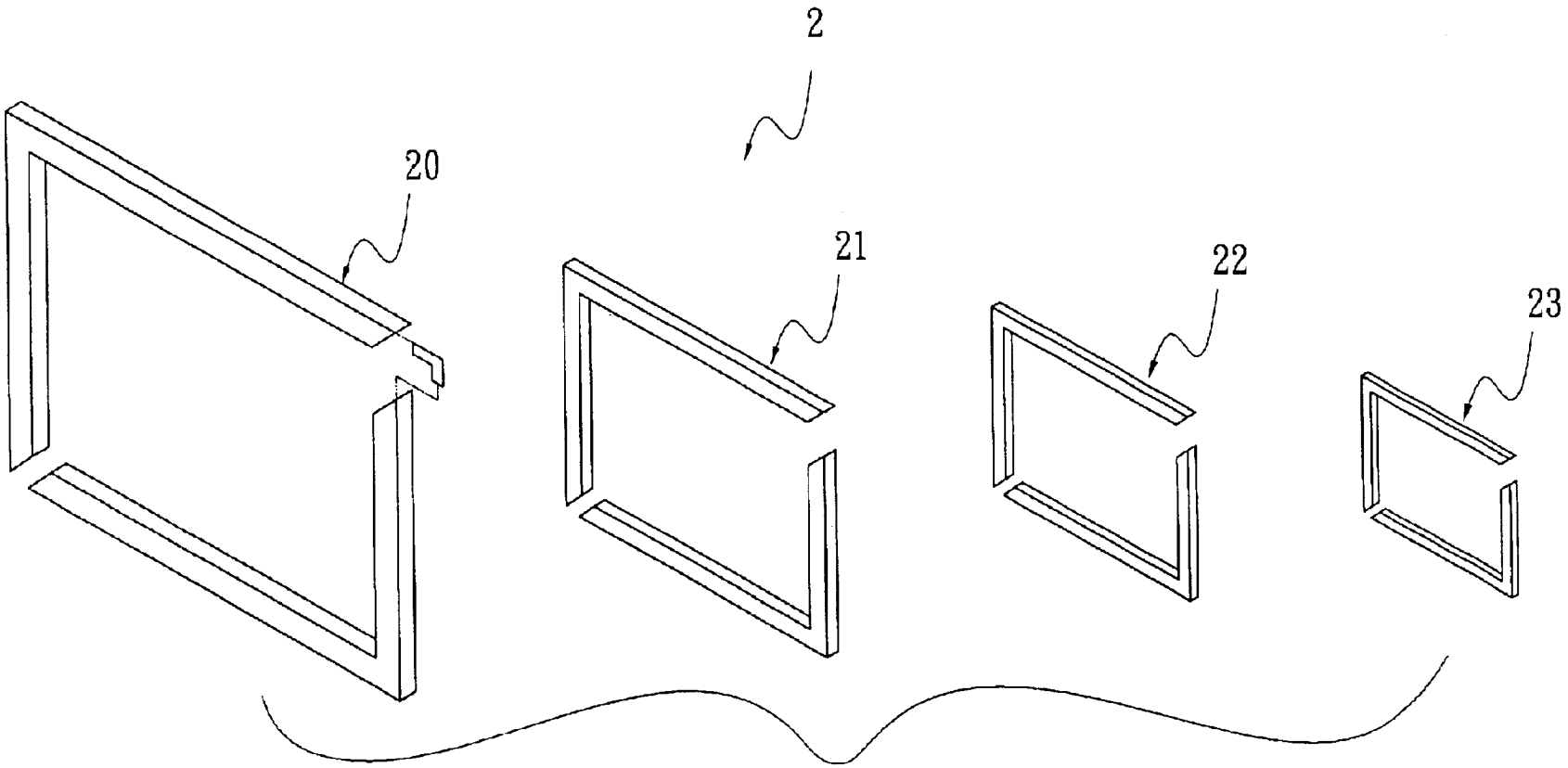
FIG. 6 is a schematic view of the frame rims of different dimensions for coupling in a diagonal manner according to the invention.

Refer to FIGS. 4 and 5 for the forming molds of the invention. The invention aims at providing a method for fabricating oven shells that can be coupled according to user's requirements and save molding costs. The invention includes forming molds 1 and 1' that have a plurality of indented trough zones 10 and 10' formed diagonally and spaced from one another at desired intervals according to preset frame rims 2 and panels 3. Then a selected metal (such as copper, aluminum, zinc, steel, etc.) is processed by die casting through the forming molds 1 and 1' to form frame rims 20, 21, 22, and 23 (referring to FIG. 6), an upper panel, a lower panel, side panels and a rear panel 30, 31, 32, 33 and 34 of different dimensions. The frame rims 2 and panels 3 have respectively a wedging trough 210 or apertures 300 and spacing flaps 320. The frame rims 2 and panels 3 may be coupled and assembled according to preset groups to form oven shells (referring to FIG. 7).

Figure 7:
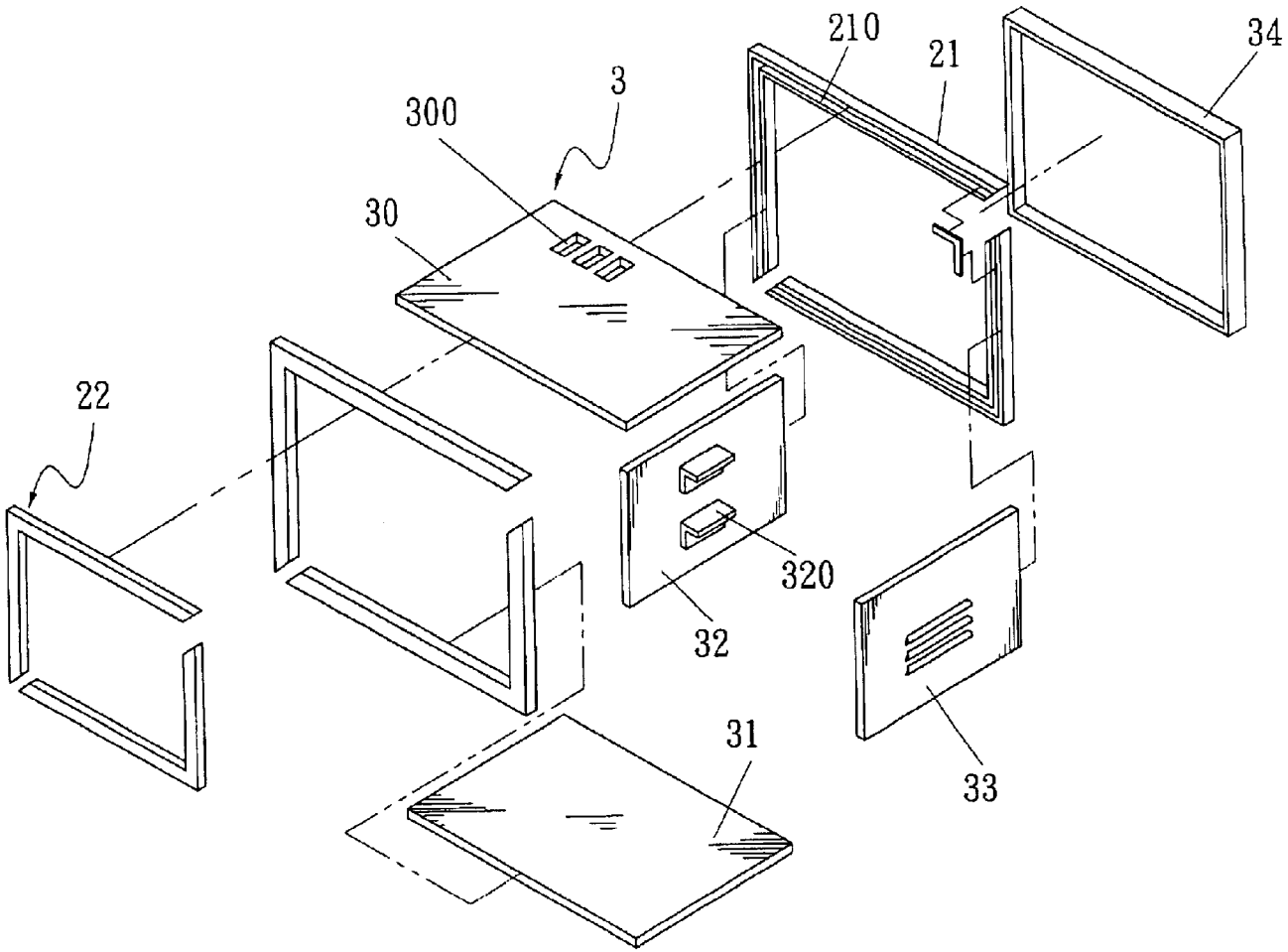
FIG. 7 is an exploded view of the oven shell of the invention.
Figure 8A:
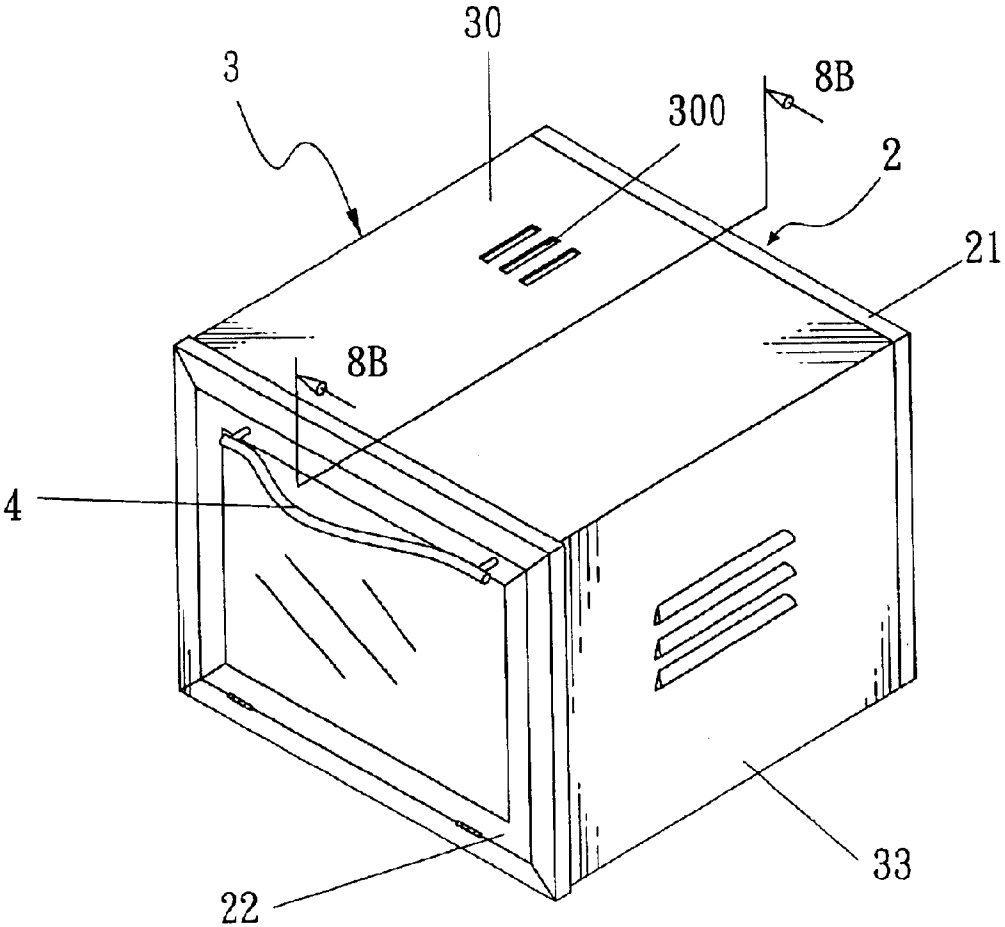
FIG. 8A is a perspective view of the oven shell of the invention.
Figure 8B:
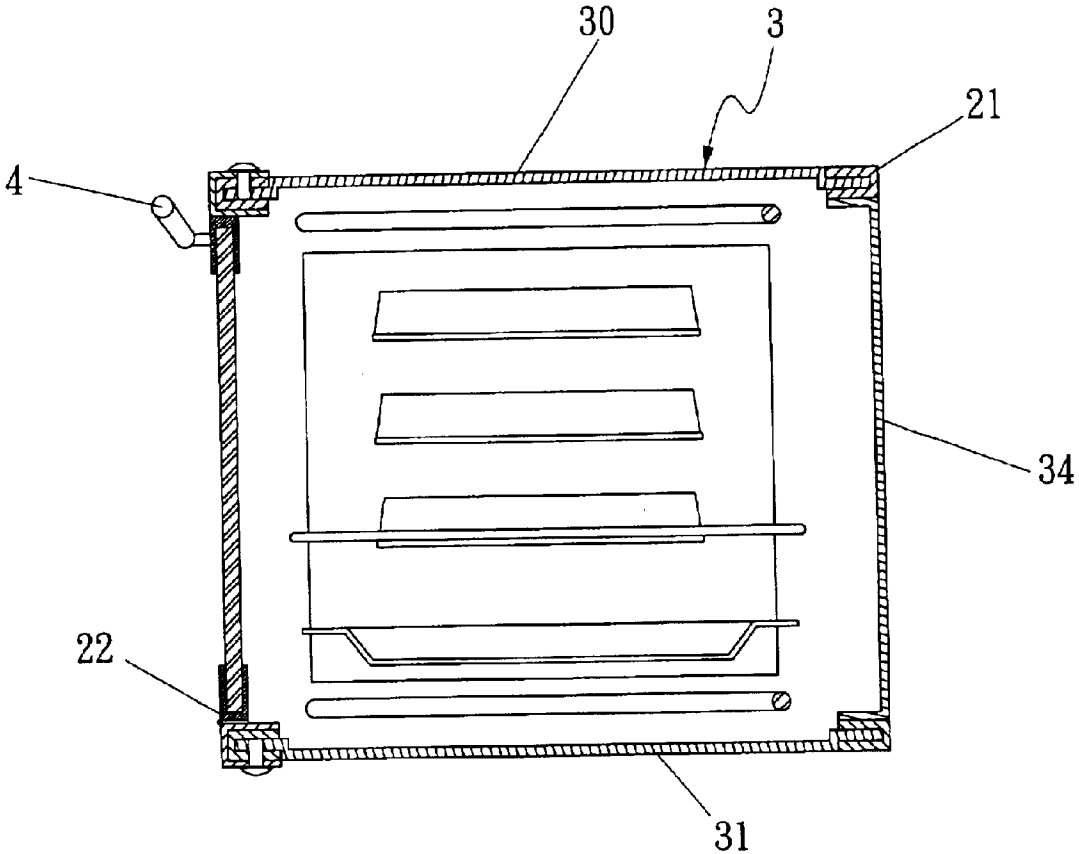
FIG. 8B is a cross section taken on line 8B—8B in FIG. 8A.

Referring to FIGS. 7 and 8A, for assembling the oven shell, first, position and couple the front and rear frame rims 21, and the upper, lower and side panels 30, 31, 32 and 33 that are formed by the forming molds 1 and 1' and wedged in the wedge troughs 210 located on the inner side of the frame rims 21; next, position and anchor the frame rim 22 of a smaller size on the front end frame rim 21; then fasten the handle 4; thereafter, couple the frame rims 21 and 22, and the upper, lower and side panels 30, 31, 32 and 33 to complete the oven shell (as shown in FIG. 8B).

Figure 9:
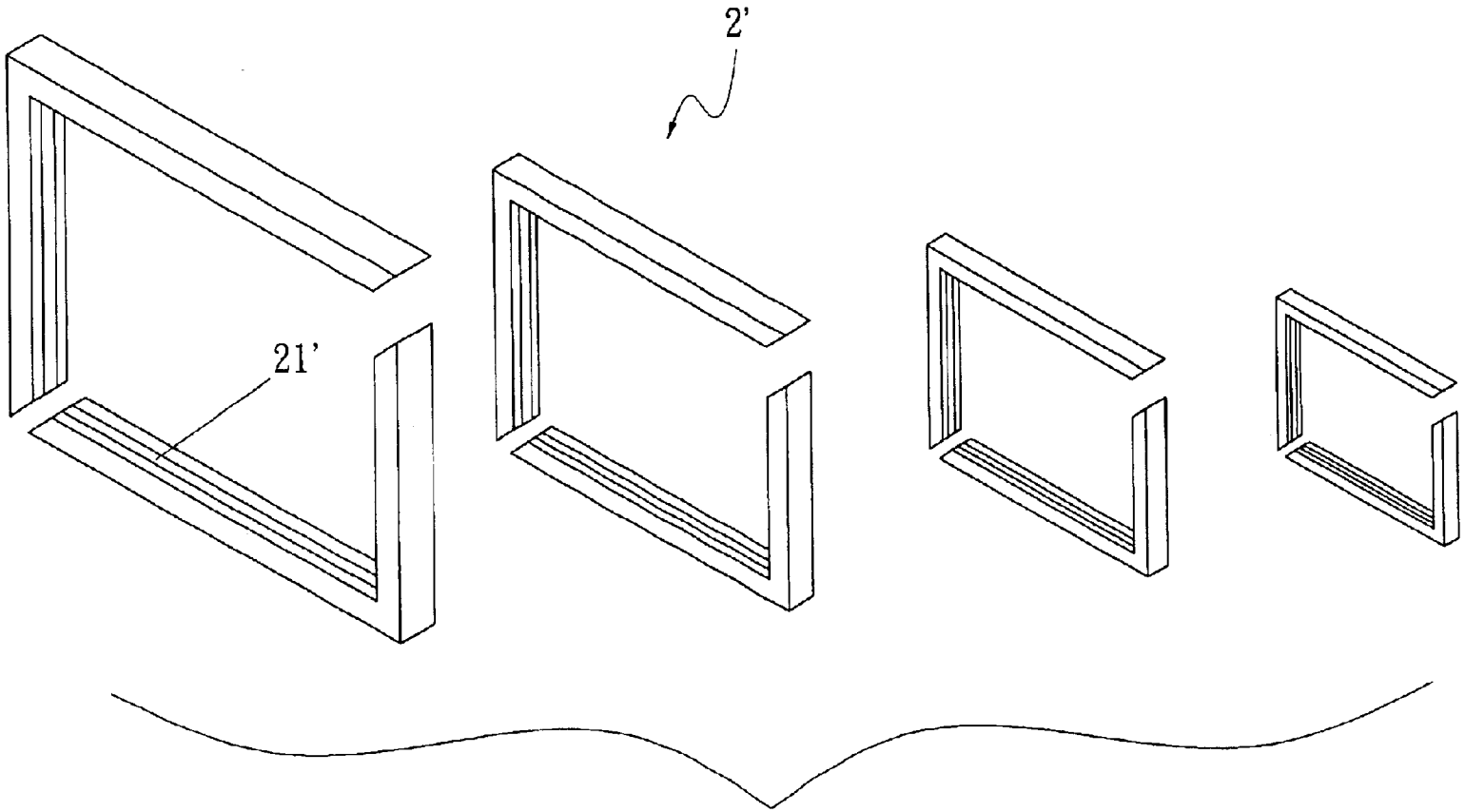
FIG. 9 is a schematic view of the frame rims of different dimensions of another embodiment according to the invention.

Refer to FIG. 9 for another embodiment of the invention. It is substantially like the one shown in FIG. 6 with the frame rims of different dimensions formed by the forming molds. The only difference is that the inner frame surface of the frame rim 2' has a flute 20'.

Figure 10:
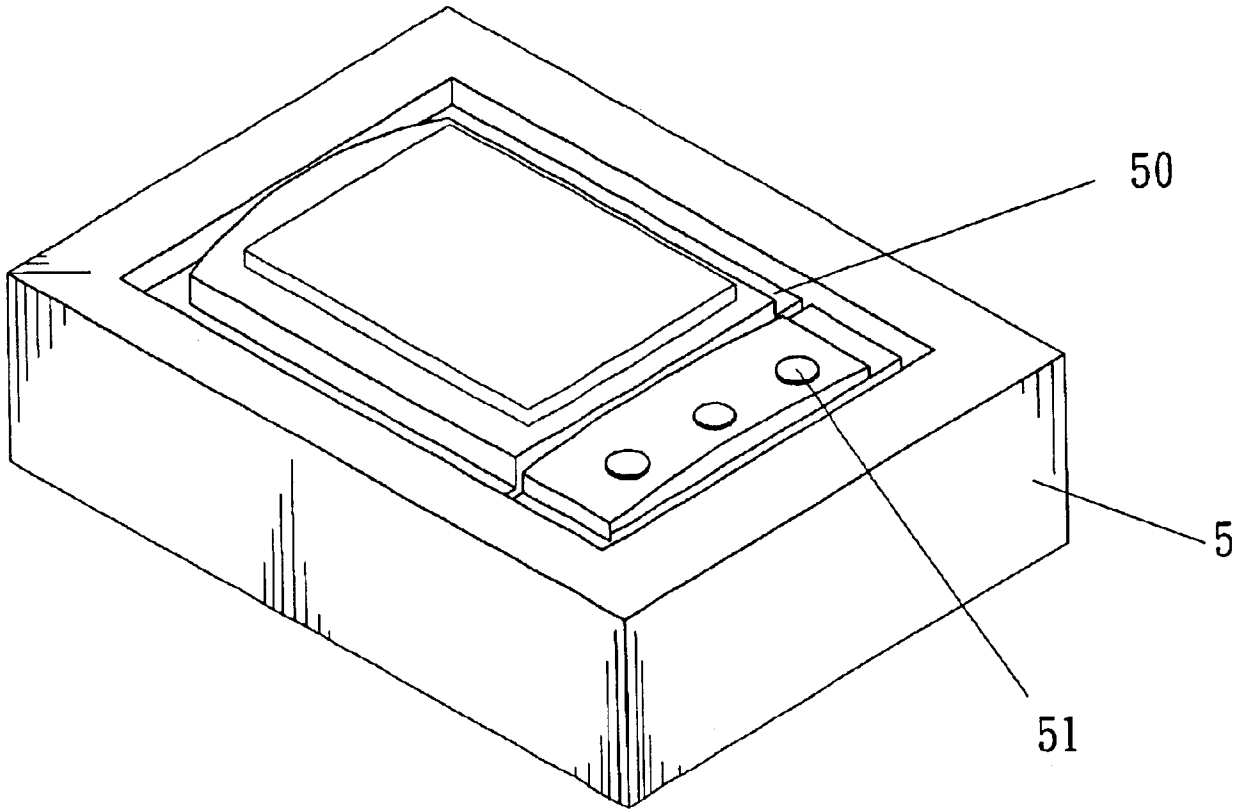
FIG. 10 is a perspective view of a forming mold for a frame rim of another embodiment of the invention.
Figure 11:
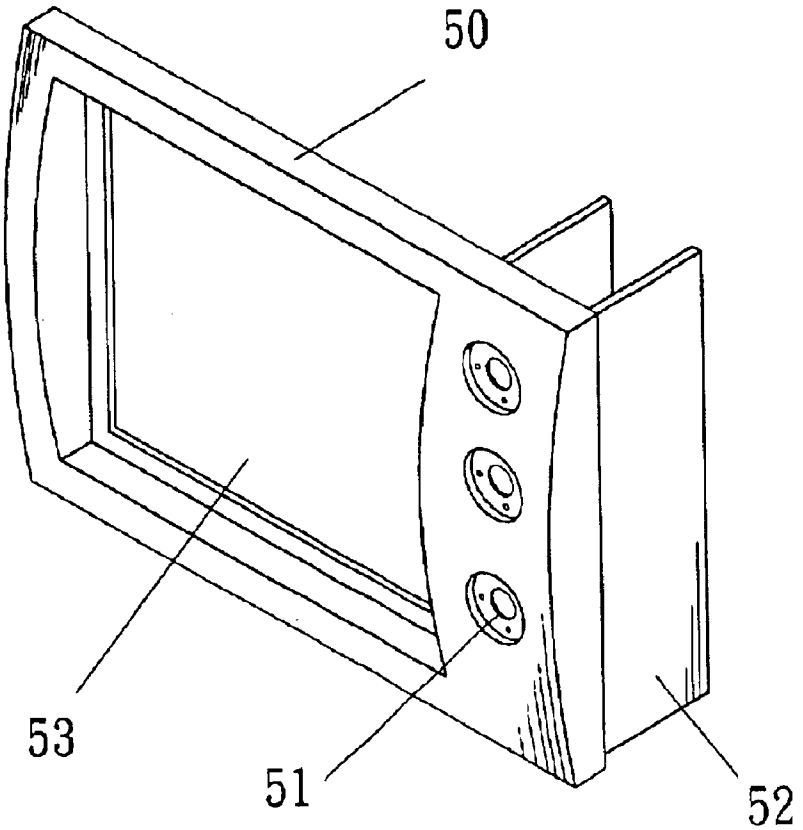
FIG. 11 is a perspective view of the frame rim according to FIG. 10.
Figure 12:
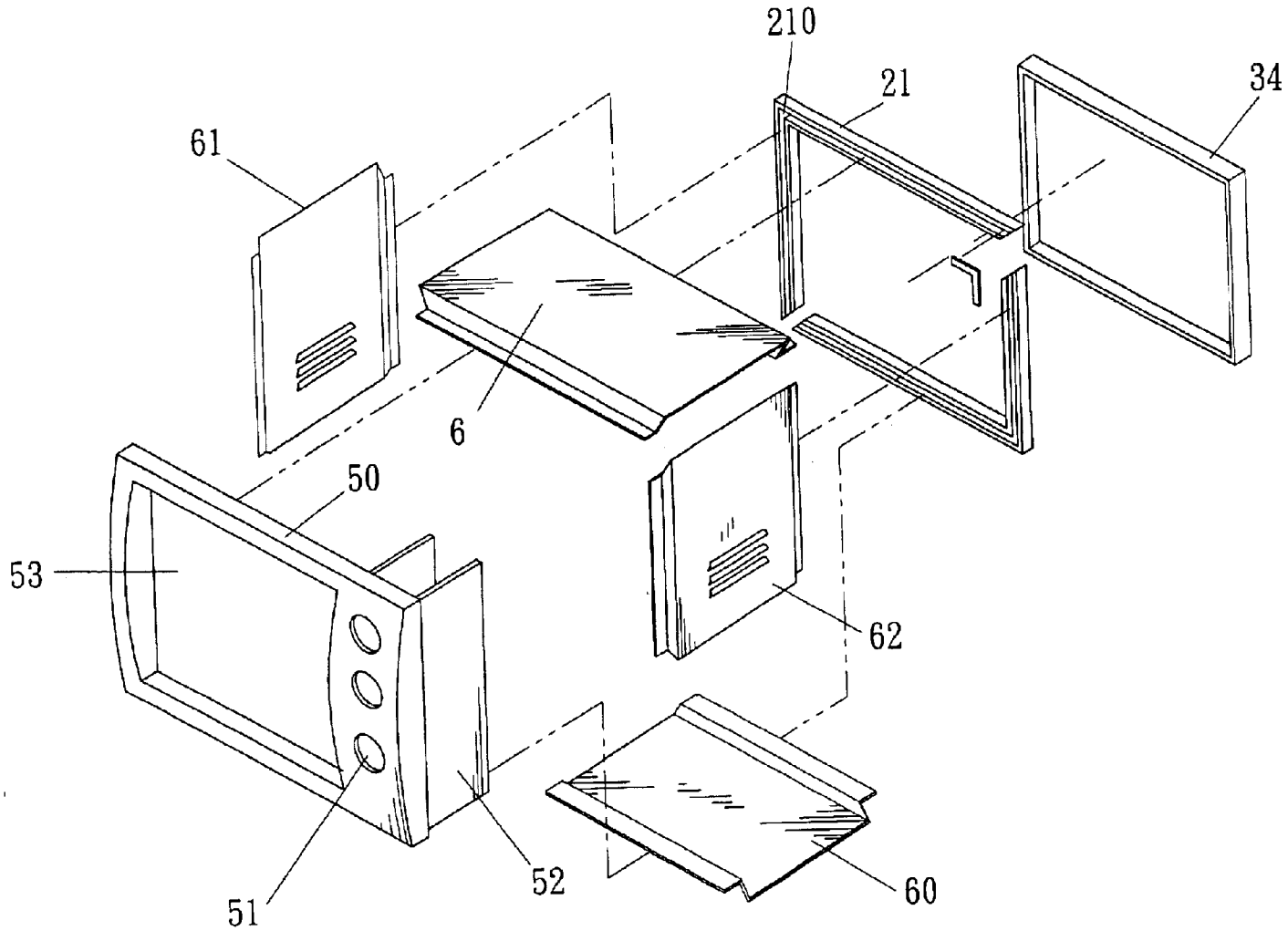
FIG. 12 is an exploded view of the oven shell according to FIG. 10.

Refer to FIGS. 10 and 11 for another embodiment of the molding mold 5 of the invention for forming the frame rim. The frame rim 50 is integrally formed, and has button knob openings 51, a power supply installation zone 52 on the rear end and a viewing window zone 53. The frame rim 50 is coupled with upper, lower and side panels 6, 60, 61, 62 and 63 each has two ends flanged to form a wedge ledge. The frame rim 21 on the rear end has an inner surface with a wedge trough 210 formed thereon. The panels thus coupled and assembled form another type of oven shell (referring to FIG. 12).

Figure 13:
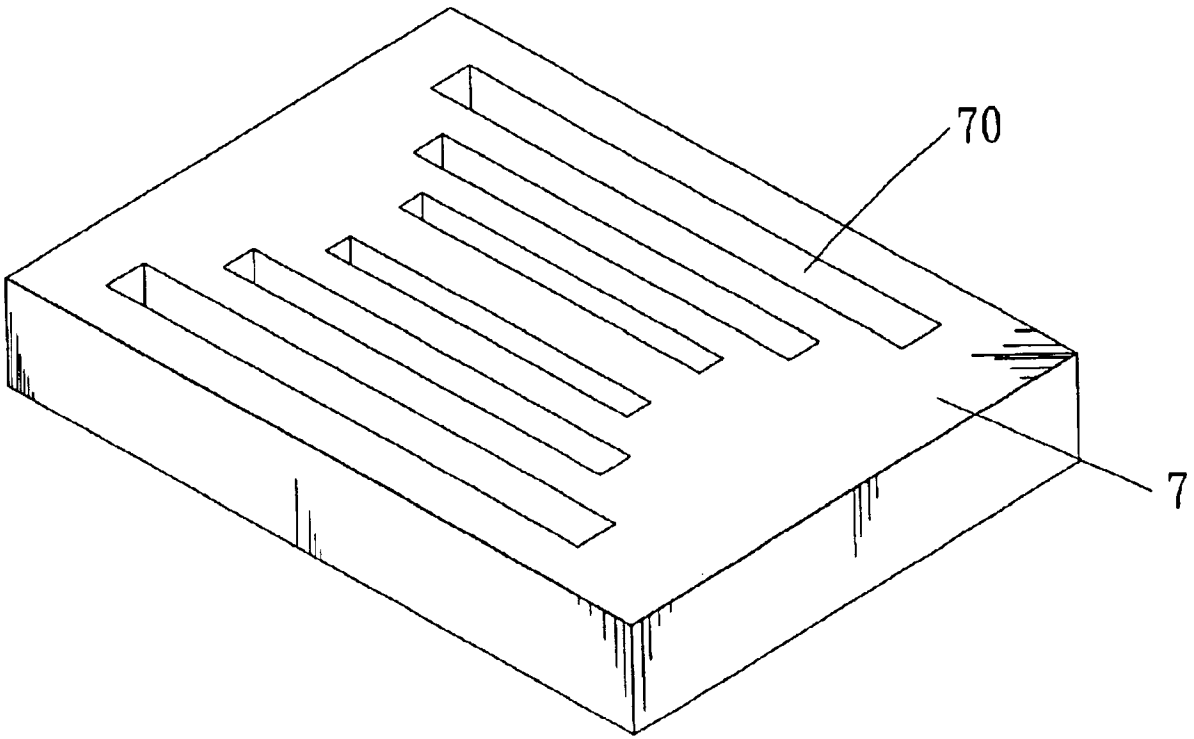
FIG. 13 is a perspective view of a forming mold for a frame rim of yet another embodiment of the invention.
Figure 14:
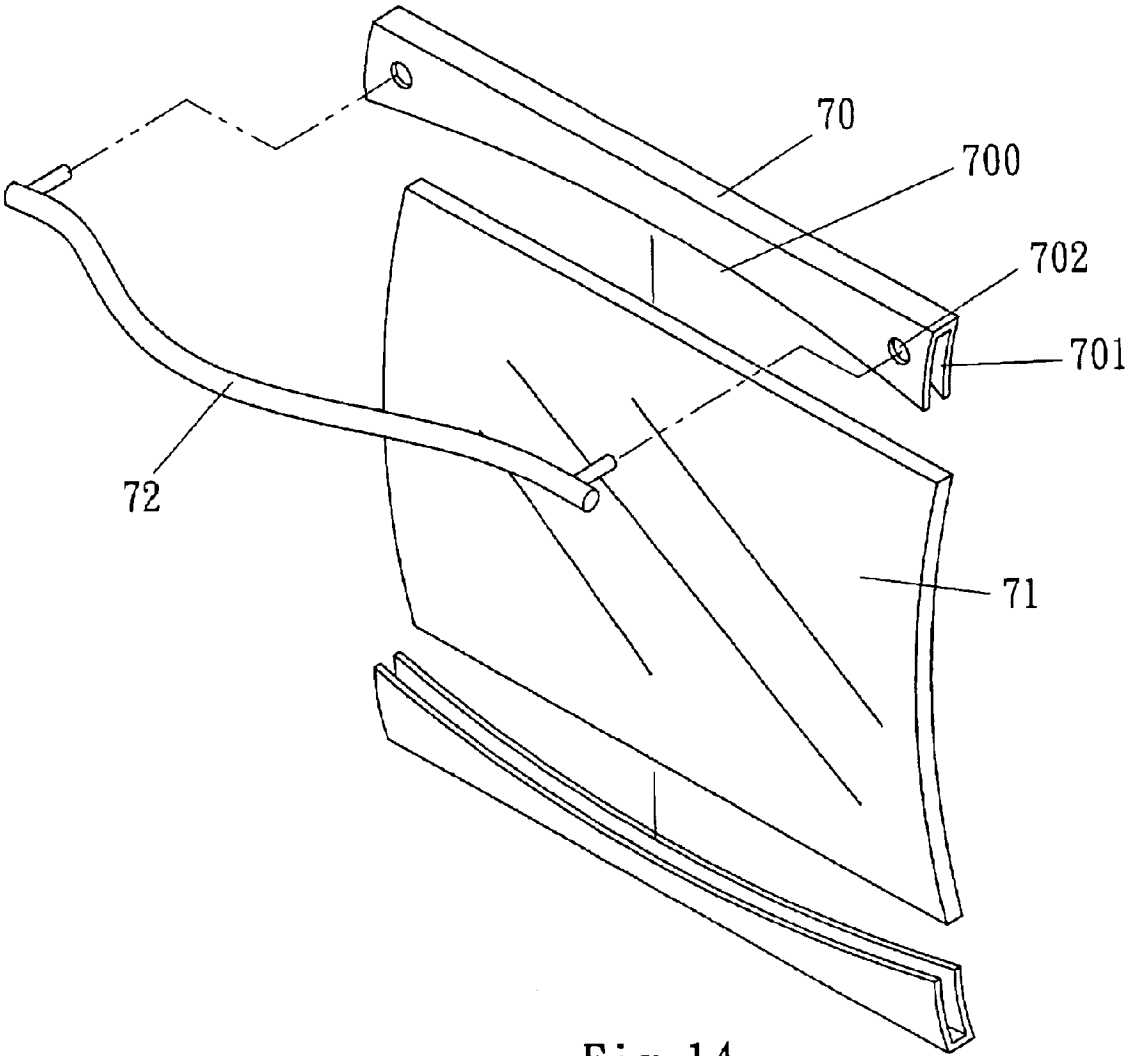
FIG. 14 is an exploded view of the frame rim according to FIG. 13.
Figure 15:
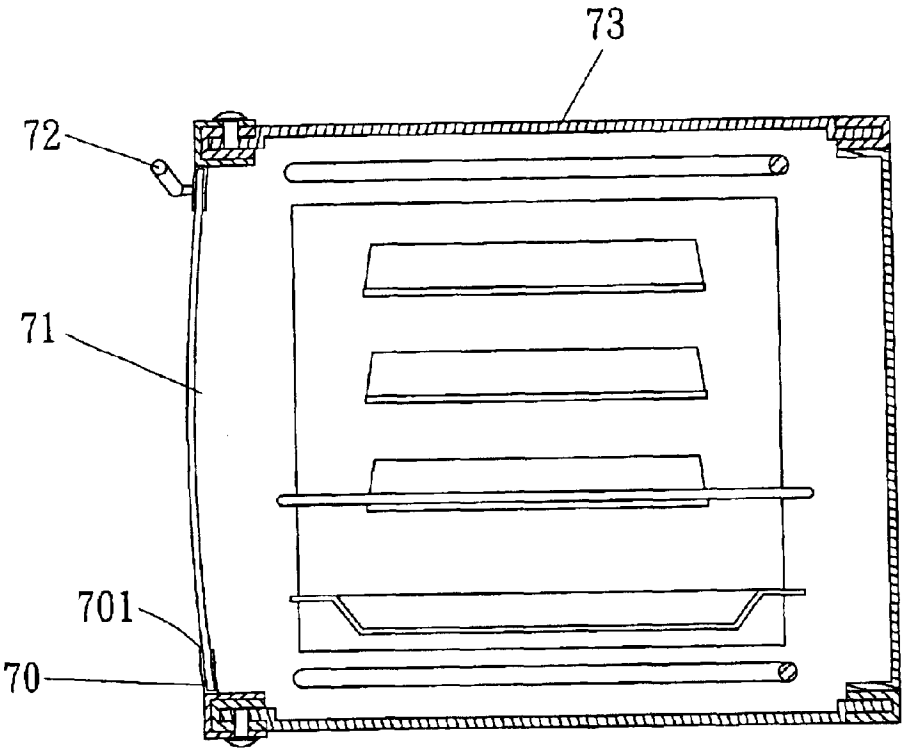
FIG. 15 is a cross section of the oven shell assembly according to FIG. 13.

Refer to FIG. 13 for yet another embodiment of the invention. A transverse frame 70 having an inner concave rim 700 is formed by a forming mold 7. The transverse frame 70 has a wedge trough 701 and apertures 702 located on two ends. An arched viewing window 71, a handle 72 and side panels 73 may be coupled thereon to form another type of oven shell (as shown in FIGS. 14 and 15).

What is claimed is:

1. A method for fabricating an oven shell, comprising steps of:

a. forming a set of L-shaped indented troughs spaced from one another for a selected interval on diagonal locations on forming molds according to preset frame rims and panels;

b. forming frame rims and an upper panel, a lower panel, side panels and a rear panel of different dimensions through the forming molds by die casting a metal material; and c. coupling and positioning the front and the rear frame rims and the upper panel, the lower panel and side panels that have been wedged in wedge troughs located on an inner side of the frame rims, and coupling another frame rim of a smaller dimension to the frame rim at the front end and fastening a handle, and assembling the frame rims and the upper panel, the lower panel and the side panels to form the oven shell.

2. The method of claim 1, wherein the metal material is selected from the group consisting of copper, iron, and stainless steel.

3. The method of claim 1, wherein the forming molds are made for fabricating an integrated frame rim, the frame rim having button knob openings, a viewing window zone and a power supply installation zone.

4. The method of claim 1, wherein the forming molds are made to form transverse frames that correspond to each other, each transverse frame having a concave rim and a wedge trough on the bottom section thereof.

* * * * *